United States Patent [19]

Bungert et al.

[11] Patent Number: 4,643,118

[45] Date of Patent: Feb. 17, 1987

[54] SEWING MACHINE WITH STEP MOTOR OPERATED FEED DEVICE

[75] Inventors: Heinrich Bungert, Kaiserslautern; Mathias Ulmen, Kindsbach; Herbert Wenz, Kaiserslautern, all of Fed. Rep. of Germany

[73] Assignee: Pfaff Industriemaschinen GmbH, Fed. Rep. of Germany

[21] Appl. No.: 861,229

[22] Filed: May 8, 1986

[30] Foreign Application Priority Data

May 9, 1985 [DE] Fed. Rep. of Germany ..... 3516715

[51] Int. Cl.[4] ..... D05B 27/14; D05B 27/06; D05B 35/10

[52] U.S. Cl. ..... 112/318; 112/306; 112/317

[58] Field of Search ..... 112/318, 322, 314, 317, 112/306, 315, 316, 319, 303, 275, 277, 121.11, 153, 312

[56] References Cited

U.S. PATENT DOCUMENTS 4,109,595 8/1978 Ducol et al. ..... 112/312 X
4,181,085 1/1980 Conner, Jr. ..... 112/153
4,295,435 10/1981 Uemura et al. ..... 112/322
4,318,360 3/1982 Uemura et al. ..... 112/318
4,462,326 7/1984 Perego et al. ..... 112/318

*Primary Examiner*—Peter Nerbun
*Attorney, Agent, or Firm*—McGlew and Tuttle

[57] ABSTRACT

In a sewing machine with a feed device which comprises a feed wheel arranged next to a stitch formation point, driven synchronously with stitch formation tools, and mounted in a support provided at the housing of the sewing machine, in order to obtain an extremely exact drive in both directions, the feed wheel is placed in driving connection with a step motor. In a manner known in itself, the step motor receives stepping pulses which can be generated by a pulse generator operating synchronously with a main shaft of the machine and via a counting device that determines the feed amount. This feed amount is presettable by selectable digital data contained in a memory. In an arrangement wherein the feed wheel is connected to its drive via a deflection gearing and a transmission shaft mounted in the support, the deflection gearing consists of a ring gear attached to the feed wheel and of a pinion firmly connected to the transmission shaft. An especially compact solution results by attachment of the step motor on the support and by rigid coupling of its output shaft to the transmission shaft.

10 Claims, 6 Drawing Figures

STEP M
42
STEP M
96
POWER STAGE
118
POWER STAGE
119
MEMORY
116
116a
119a
118a
112a
115a
115
DISPLAY
DOWN COUNT.
112
DOWN COUNT.
113
113a
110
114a
114
KEY PANEL
CONTROL UNIT
105
125a
125
108
109
109a
E1
E2
E1
E2
DIVIDER
124
108a
106a
106
E1
E2
OSC.
123
122
121
120
134
103
100
104
103
102
101
130
6

SEWING MACHINE WITH STEP MOTOR OPERATED FEED DEVICE

FIELD AND BACKGROUND OF THE INVENTION

The present invention relates in general to sewing machines and in particular to a new and useful sewing machine with a step motor operated feed device which utilizes a feed wheel disposed next to a stitch formation point and which is driven synchronously with stitch formation tools, the feed wheel being driven by a step motor.

In a known sewing machine of this kind (U.S. Pat. No. 2,275,716), the drive of the feed wheel occurs from the main shaft of the sewing machine via a stepping mechanism which imparts an intermittent feed movement to the feed wheel. For continuously variable adjustment, such a stepping mechanism must be designed as a clamping mechanism with a free-wheeling coupling. Due to their frictional entrainment, such stepping mechanisms are very inaccurate, and besides, they cannot be used for driving in a reverse direction. Especially at varying speeds of a sewing machine, because of the large inertial mass of the mechanical transmission parts, there results a considerable slip in the drive transmission and hence considerable deviation of the executed stitch length from the set value. Backward sewing is not possible at all with this sewing machine.

SUMMARY OF THE INVENTION

It is the object of the present invention to provide a drive for the feed device in such a way that small amounts in the forward direction as well as in the opposite direction, can be executed.

Accordingly an object of the present invention is to provide a sewing machine with a feed device which comprises a feed wheel disposed next to a stitch formation point and driven in synchronism with stitch formation means, the feed wheel being mounted and the support provided at the housing of the sewing machine, the feed wheel being operatively connected to a step motor for rotating the feed wheel and to which is supplied stepping pulses over a power stage which are formed by a pulse generator operating in synchronism with a main shaft of the sewing machine, and with a counting device which determines the feed amount and which is presettable by selected digital data contained in a memory.

The term "feed wheel" is understood here to mean either a sliding wheel arranged below the work or a roll foot arranged above it or both. This results in an arrangement which transports work most exactly in both feed directions and which is outstanding for its low inertia without any slip whatsoever. Switching from forward to backward stitching for making a bar is possible at highest speed, with the same stitch length being preserved.

A further object of the invention is to provide a sewing machine as defined above, wherein a deflecting or miter gear and a transmission shaft is mounted in the support, the deflecting or miter gear comprising a ring gear attached to the feed wheel and a pinion firmly connected to the transmission shaft, the step motor being secured to the support and having an output shaft which is rigidly coupled to the transmission shaft.

By this measure, an especially short transmission path is obtained in an arrangement wherein the feed wheel is connected to its drive via a deflection gearing and a transmission shaft mounted in the support, the deflection gearing consisting of a ring gear attached to the feed wheel and of a pinion firmly connected to the transmission shaft, with all the advantages thereof. Especially for the drive of the roll foot, which must be mounted moveable in its height position and whose support must also be mounted for outward pivoting for the threading of the needle, such a compact arrangement is practically mandatory if a clumsy complicated drive is to be avoided.

An especially favorable solution for use of a relatively small step motor usable in a limited space, results from the use of a spiroid gearing as the deflecting gearing. A spiroid gearing is a helical gearing with crossed but not intersecting axes. In a spiroid gearing a plurality of teeth is in engagement simultaneously. In addition, the contact line of the sliding movement is practically perpendicular to the direction of force. The arc radius of the contact lines is substantially greater than in a worm gear of comparable size. This results in a fully sliding motion along the entire surface of the tooth sides of the ring gear and also in a uniform running without irregularities and an extradordinary firmness of the gearing. Above all, the gears can be made to run without play. Thus the spiroid gearing has a high force transmission capacity and by the selection of appropriate pitch angles, very high transmission ratios can be obtained. Due to the small distance between the centers of the ring gear and pinion, the design is extremely compact. Moreover, the spiroid gearing is self-locking, so that there is no need for a brake to prevent forward or reverse running and there are no reactions through the workpiece to the feed wheel. But on the other hand, drive in both feed directions is possible. It is gearing which runs quietly, is easy and inexpensive to manufacture, and can operate with a small servometer.

Another object of the invention is to provide the sewing machine with a support which is mounted on an eccentric bolt rotatably secured to the housing of the sewing machine. The support is thus moveable in a vertical direction and can be fixed in a selected position by a clamping connection arranged at a location space from the eccentric bolt.

This results in an especially simple adjustability both with regard to the height of the sliding wheel part protruding from the stitch plate as well as the lateral position of the sliding wheel inside the stitch plate slot.

Another feature of the invention is to provide the support for the feed wheel as two parts, one of which receives the transmission shaft and step motor and which is secured for axial displacement to the other part which is formed as a tubular piece. This offers an especially simple solution for play-free setting of the gear connection.

Other features of the invention include the use of circuitry for interpreting pulses from the pulse generator, the circuitry including a reversing arrangement and counting devices which are connected to an oscillator for delivering constant pulses. The circuitry includes a turnoff device which stops the stitch formation mechanism in at least one position of the needle when it is withdrawn from the work and includes control means connected to the pulse generator and the counter and connected to the memory which contains the digital data. The reversing arrangement can be switched to the oscillator when the sewing machine is at a standstill for supplying pulses to the counter. In this way the preset feed execution is ended after each stopping process, thus preventing a faulty feed at the beginning of the next stitch.

A position correction of the workpiece relative to the needle, not hitherto possible in sewing machines with feed drives, can be realized by a circuit arrangement, wherein the oscillator is switchable via a switch, circumventing the counting device.

According to other features of the invention, rotation means are provided for rotating the work or workpiece about the needle. The feed wheel cooperates as part of the rotating means with pulses being supplied to the step motor for moving the feed wheel, both when the needle is inserted in the workpiece and when it is withdrawn from the workpiece. A sensor may also be provided which scans the edge of the workpiece at a measuring point disposed laterally before the stitch formation point.

In this way curved seams can be produced automatically according to a predetermined program, or edge-parallel seams can be made by scanning the edge of the workpiece.

As compared with known solutions (U.S. Pat. Nos. 3,080,836 and 3,472,187), a separate rotating device and the entire drive thereof thus become superfluous. This results in an arrangement which, besides the mechanical parts required for the normal feed, requires no other cost for parts. This solution is thus extremely simple and inexpensive.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

An embodiment of the sewing machine according to the invention is illustrated in the drawings wherein.

DESCRIPTION OF THE PREFERRED EMBODIMENT

Figure 1:
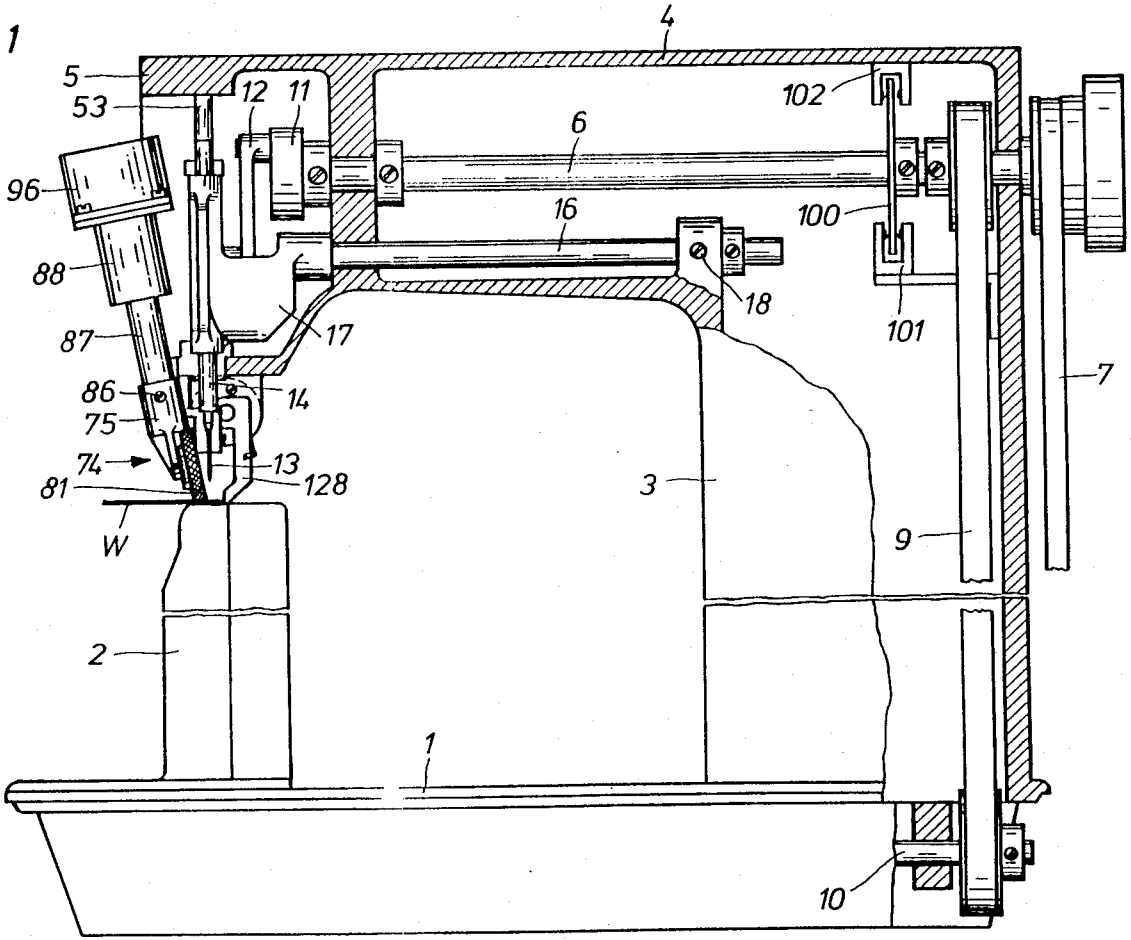
FIG. 1 shows an overall view of a sewing machine equipped with a feed device, partly in section.

As shown in FIG. 1, the sewing machine consists of a base plate 1, a column 2, a standard 3, and arm 4 and a head 5 which together form a housing. In arm 4 a main shaft 6 is mounted in the usual manner for rotation. It is driven via a V-belt 7 by a motor (not shown) attached below the base plate 1. By a toothed belt 9 a rotary hook shaft 10 which is mounted in the base plate 1 and which is in driving connection with a rotary hook (not shown) is driven from the main shaft.

Figure 2:
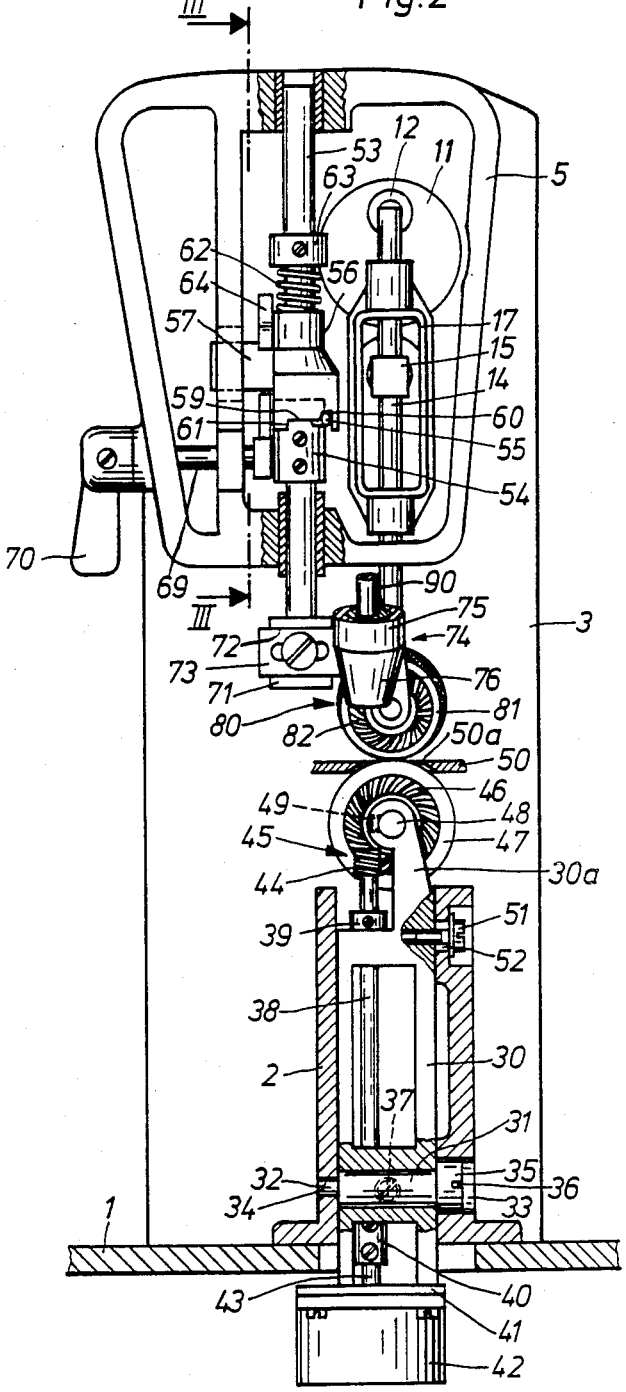
FIG. 2, an enlarged side view of the sewing machine according to FIG. 1, partly in section.

The main shaft 6 drives, via a crank 11 and a link 12, a needle bar 14 with needle 13. Link 12 is articulated to the needle bar 14 through a joint connection 15 (FIG. 2). The needle bar is mounted in a guide 17 secured on an axle 16 (FIG. 1). Axle 16 is mounted parallel to the main shaft 6 in arm 4 and is firmly connected to arm 4 by a screw 18.

In the lower part of column 2 (FIG. 2) a support 30 is mounted on an eccentric bolt 31 which has journals 34 and 35 protruding into bores 32 and 33 in column 2. Journal 35 is provided with a slot 36. Eccentric 31 is clamped on support 30 by a screw 37. Mounted in support 30 is a vertical shaft 38, which is guided and held in the axial direction by an adjusting ring 39 and a coupling 40. At the lower end the support 30 is equipped with a flanged plate 41 on which a step motor 42 is secured whose output shaft 43 is rigidly coupled to the vertical shaft 38 by coupling 40. At the upper end the vertical shaft 38 carries a pinion 44 of a spiroid gearing 45, the ring gear 46 of which is firmly connected to a sliding wheel 47 which is mounted by ball bearings in known manner and has an inner part with an axle end 48. The axle end 48 is received by a bore in an arm **30*a* of support 30 and can be clamped by a screw 49** after adjustment in the axial direction.

By rotation of the eccentric bolt 31 with the aid of slot 36, the sliding wheel 47 is adjustable in its height position relative to a stitch plate 50 via the support 30, which stitch plate terminates the column 2 at the top, and through which wheel 47 protrudes through a slot **50*a* in plate 50**.

By a screw 51 in its upper part passing through a slot 52 in column 2, the support 30 is clamped to the column after it is adjusted. The lateral position of the sliding wheel can be aligned with slot **50*a* in stitch plate 50 using axle end 48 and screw 49**.

In head 5 of the sewing machine, a vertical shaft 53 is mounted loose for axial motion and rotation. A clamping piece 54 is screwed to shaft 53. It has a radial bore into which a pin 55 has been pressed. Furthermore a coupling piece 56 is mounted loosely on shaft 53. A lug 57 extending laterally away from it, protrudes through a slot in head 5 and secures the coupling piece 56 against rotation. In its lower region the coupling piece 56 is formed as an annular sector and embraces therewith the clamping piece 54. The annular sector has a recess 59 into which the pin 55 protrudes and which terminates at one end in a ratchet groove 60, while at its other end recess 59 ends with a wall 61. A compression spring 62 which braces itself against a set ring 63 fastened on shaft 53, presses the coupling piece 56 and hence the upper wall of its annular sector, lightly downwardly against pin 55.

Figure 3:
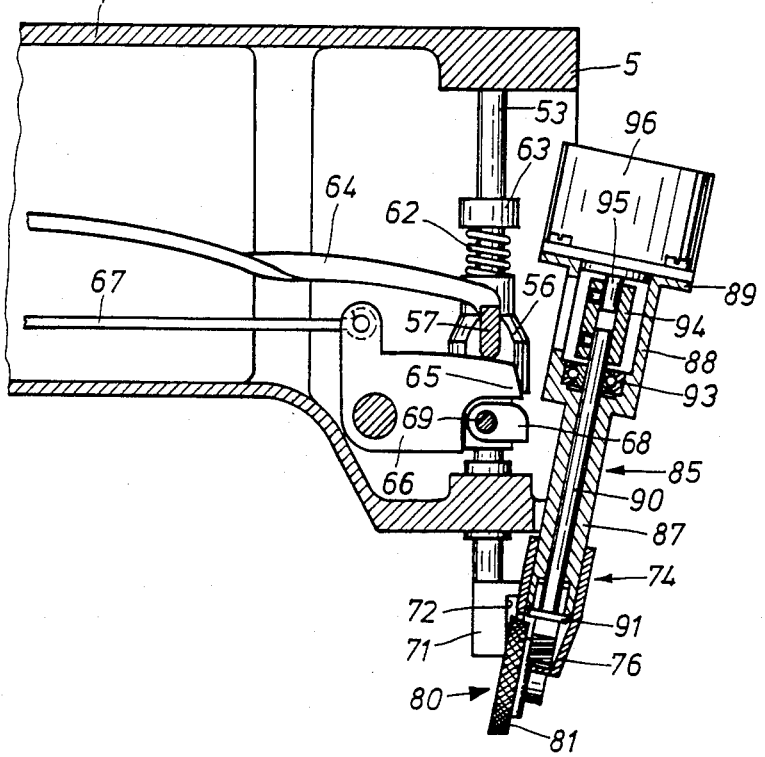
FIG. 3, a section along line III—III of FIG. 2.
Figure 4:
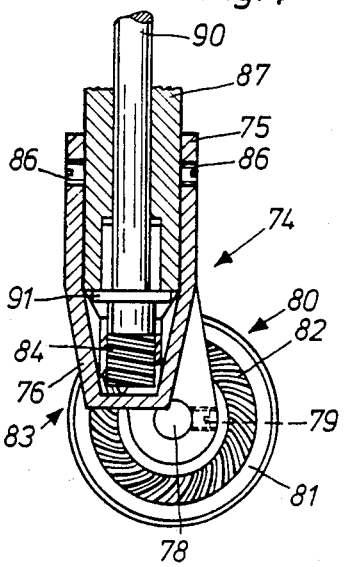
FIG. 4, a section through a part of the roll foot drive mechanism, on a larger scale.

Resting on lug 57 (FIG. 3) is the free end of a leaf spring 64, which is secured in arm 4 and pushes the coupling piece 56 downward. Below lug 57 a lever arm 65 of an angle lever 66 mounted in head 5 protrudes. Lever 66 is connected via a link 67 to a lifting linkage (not shown) to be activated by the operator. Under the lever arm 65, a cam 68 is fastened on a shaft 69 mounted in head 5. Shaft 69 (FIG. 2) carries on its outwardly protruding end, a hand lever 70. At the lower end of shaft 53, a block 71 is fastened which has a groove guideway 72. In the guideway 72, an angular slotted lobe 73 is screwed tight, which is firmly connected to a roll foot support 74. The support 74 has a tubular piece 75 (see also FIGS. 3 and 4), terminating in a downwardly protruding end piece 76. In the end piece 76 a bore for attachment of an axle end 78 of a ball-bearing roll foot 80 by a screw 79 is provided. The roll foot 80 has a race 81 to which a ring gear 82 of a spiroid gearing 83 is firmly connected. The pinion 84 of spiroid gearing 83 is in engagement with the ring gear 82, eccentrically. A tubular support 85 is received in the tubular piece 75, which is clamped in its position by screws 86 screwed in the tubular piece 75. The support 85 consists of a tube 87, a hollow cylinder 88 continguous toward the top, and an annular end flange 89. In tube 87, a shaft 90 is mounted which carries at its lower end the pinion 84 and is firmly connected to a ring shoulder 91 which abuts against the lower end of tube 87.

Shaft 90 is embraced in the region of its upper end by the inner race of a ball bearing 93 pressed into the hollow cylinder 88. The upper end of shaft 90 is rigidly coupled, by a coupling 94, to an output shaft 95 of a step motor 96, the housing of which is screwed tight on the end flange 89.

Figure 6:
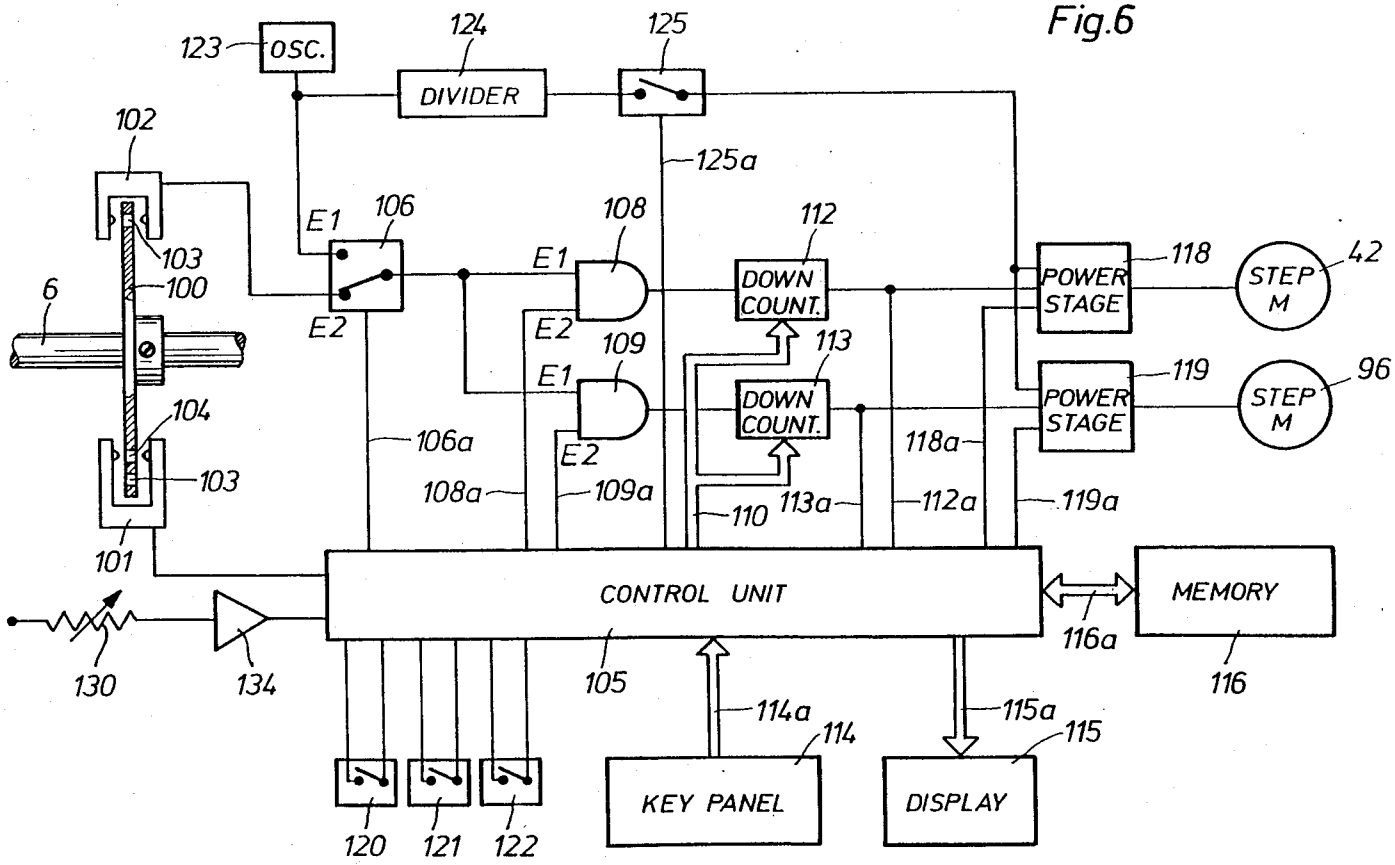
FIG. 6, a block diagram of the electronic circuit for the feed device.

On the main shaft 6 (FIG. 1) of the sewing machine a strobe disk 100 is mounted which has two pulse tracks, each cooperating with a pulse generator 101, 102. One track has a plurality of pulse markers 103 uniformly distributed on its circumference (FIG. 6), while the other track has only one pulse marker 104 passing by the pulse generator 101 when the needle 13 emerges from the workpiece.

The pulse generator 101 is connected to a control unit 105. Control unit 105 is connected to a reversing arrangement 106 via a control line 106*a* and, via control lines 108*a* and 109*a* to AND elements 108 and 109. A bus line 110 connects counting devices 112 and 113 to unit 105. Further there are connected to the control unit 105, via a bus line 114*a* a key panel 114, via a bus line 115*a* a display unit 115, and via a bus line 116*a* a data memory 116.

The outputs of the counting devices 112 and 113 are connected to inputs of power stages 118 and 119 for the associated step motors 42 and 96. Further, the outputs of the counting devices 112 and 113 are connected to the control unit 105 via lines 112*a* and 113*a*. Lines 118*a* and 119*a* lead from the control unit 105 to the power stages 118 and 119. Also connected to the control unit 105 are three further switches 120, 121 and 122, of which switch 120 serves to actuate a backward sewing process, while the two switches 121 and 122 are provided for slow drive of the step motors 42 and 96 in forward and backward directions with the sewing machine standing still, preferably in a needle-up position. To this end an oscillator 123 is connected to the two power stages 118 and 119 via a divider 124 and a switch 125. Switch 125 is connected to the control unit 105 via a control line 125*a* In addition, oscillator 123 is connected to the input E1 of the reversing arrangement 106, the input E2 of which is connected to the pulse generator 102. The output of the reversing arrangement 106 leads to the inputs El of the two AND elements 108 and 109, the outputs of which are connected to the respective counting devices 112 and 113, which are designed as down counters and which are presettable singly by the control unit 105 via the bus line 110.

With the key panel 114, one can preselect the number of steps of the step motors 42 and 96 to be executed per sewing stitch and hence the feed length of the individual transport organs-sliding wheel 47 and roll foot 80—between each stitch formation, with the possibility of setting different feed amounts of the sliding wheel 47 and of the roll foot 80. The preselected stitch length is indicated in the display unit 115.

The device operates as follows:

Using the key panel 114 the operator sets the desired feed amounts of the sliding wheel 47 and of the roll foot 80, corresponding digital values being taken out of the data memory 116 via the control unit 105 and thereby the counting devices 112 and 113 being preset. At the same time values corresponding to the feed amounts are indicated in the display unit 115.

During operation of the sewing machine, the sewing motor (not shown) drives the main shaft 6 over V-belt 7, which moves the needle bar 14 up and down via the drive connection of crank 11 and link 12. In addition the rotary hook drive shaft 10 is driven over toothed belt by the main shaft 6 to drive the shuttle (not shown). The drive for advance of the workpiece is actuated via the pulse generator 101 whenever the needle 13 leaves the workpiece. The pulse generator 101 then delivers a pulse to the control unit 105. Via the control lines 108*a* and 109*a*, the control unit now switches the potential at the inputs E2 of the AND elements 108 and 109 to H (high), so that the pulses originating thereafter from the pulse generator 102 are allowed to pass from the AND elements 108 and 109 to the counting devices 112 and 113 via the reversing arrangement 106 switched to input E2 during drive of the sewing machine.

When one of the counting devices 112 or 113 has reached the status "0", it delivers a control pulse to the respective power stage 118 or 119, whereby the corresponding step motor 42 or 96 is advanced by one step. At the same time this counting device 112 or 113 delivers, via the associated control line 112*a* or 113*a*, pulses to the control unit 105, which again presets this counting device 112 or 113 to a new value. The control unit 105 calls the corresponding values out of the data memory 116. At the same time the control unit 105 determines, via the control lines 118*a* and 119*a* connected to the power stages 118 and 119, whether the particular step motor 42 and 96 is being rotated forwardly or backwardly. The values presettable at the counting devices 112 and 113 are chosen so that the step motors 42 and 96 can execute their maximum number of steps within the withdrawn phase of the needle 13.

The stepping pulses acting on the step motors 42 and 96 drive the sliding wheel 47 and the roll foot 80 for joint transport action on the workpiece. By the vertical shaft 38 which is firmly coupled to the step motor output shaft 43 and by the miter gear 45, the step motor 42 drives the sliding wheel 47, while the step motor 96 at the same time drives the roll foot 80 via the shaft 90 firmly coupled to the step motor output shaft 95 and over the miter gear 83.

After the individual step motors 42 and 96 have traveled the number of steps set on the key panel 114 and depending on the correspondingly called data values from the data memory 116, the input E2 of the respective AND element 108 or 109 is switched to L (low) potential by the control unit 105 via the control line 108*a* or 109*a*, so that by the corresponding AND element 108 or 109, further passage of the clock pulses from the pulse generator is suppressed.

For backward sewing, for example for making a bar at the end of a seam, switch 120 is actuated, whereby, at the beginning of a new pulse from the pulse generator 101 via the control lines 118*a* and 119*a* at the power stages 118 and 119, the control unit 105 reverses the direction of movement of the step motors 42 and 96, so that they drive the sliding wheel 47 and the roll foot 80 in reverse direction as long as the actuation of switch 120 lasts. The execution of the step sequence of the step motors 42 and 96 occurs by calling the respective values set in the key panel 114 out of the data memory 116 in the manner described above.

During the stopping process of the sewing machine, which usually ends in the upper dead center of needle 13, the control unit 105 switches the reversing arrangment 106 to input E1, so that the pulses delivered by oscilator 123 are applied to the inputs E1 of the AND elements 108 and 109. As soon as the sewing machine stops, clock pulses from oscillator 123 are thus placed on the inputs E1 of the AND elements 108 and 109, instead of the clock pulses from the pulse generator 102. In this manner the preselected advance of the sliding wheel 47 and of the roll foot 80 is completed also after the last emergence of the needle 13 from the work, so that needle 13 is already above the next needle insertion point. As soon as the end position of the preselected feed amount has been reached, the control unit 105 turns the AND elements 108 and 109 off via the control lines 108*a* and 109*a*.

To correct the position of the workpiece relative to needle 13 when the sewing machine is stopped, slow transport of the workpiece in the forward feed direction while the sewing machine is turned off is possible by actuation of switch 121, and slow transport of the work in the backward direction is possible by actuation of switch 122. Actuation of the respective switch 121 or 122 brings about a closing of switch 125 via line 125*a*, so that pulses delivered by oscillator 123 and forwarded in reduced frequency from the divider 124, are sent to the two power stages 118 and 119, whereby the two step motors 42 and 96 are driven slowly for the drive of the sliding wheel 27 and of the roll foot 80. The movement direction of the step motors 42 and 96 is then set for forward or backward rotation via the control lines 118*a* and 119*a* at the power stages 118 and 119, depending on the actuation of switch 121 or 122.

The roll foot 80 is lifted off the work by turning the hand lever 70, with the cam 68 thus raising the coupling piece 56, via lever arm 65 of angle lever 66, over the lug 57 counter to the pressure of leaf spring 64. The same effect results also by actuation of the lifting linkage (not shown) which rotates the angle lever 66 via link 67.

Via the compression spring 62 the coupling piece 56 raises shaft 53 with the roll foot 80 fastened thereto and with the support 85, with the compression spring 62 ensuring the abutment of pin 55 in the ratchet groove 60 counter to the force of the compression spring 62, and shaft 53 can be rotated until the abutment of pin 55 on wall 61 of recess 59.

In a special form of the sewing machine, the sliding wheel 47 and roll foot 80 transport the workpiece during the operating cycle automatically by means of a process program called by the control unit 105 out of the data memory, which program controls the feed between two insertions of needle 13 into the workpiece in the above described manner and which moreover conveys to the two step motors 42 and 96, in the phase when needle 13 is inserted in the workpiece, a predetermined number of pulses in the same manner as during feed. This exerts a rotating action on the workpiece about the needle 13. This requires a second pulse marker 104, which then causes a pulse of the pulse generator 101 when needle 13 enters the workpiece.

Through the drive of sliding wheel 47 and roll foot 80 during the inserted phase of needle 13, a direction-of-rotation correction of the workpiece around needle 13 occurs during each inserted phase of needle 13 depending on the given sequence program.

Figure 5:
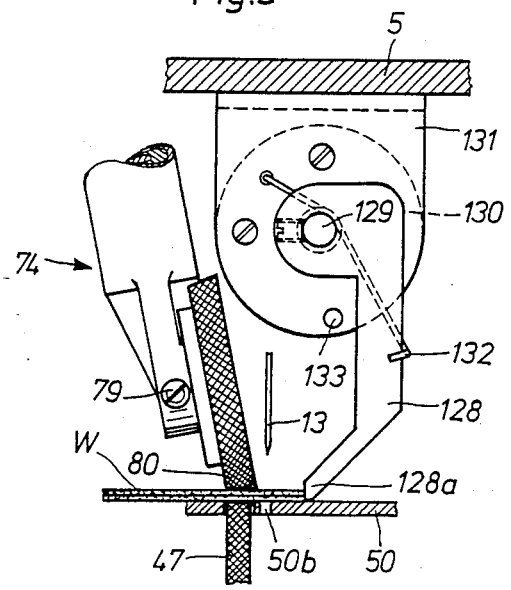
FIG. 5, an enlarged partial view of the stitch formation zone of the sewing machine according to a special form of realization.

In a further form of the sewing machine, there is provided for the scanning of the edge of a workpiece W (FIG. 5) a scanning arm 128 which is fastened on a shaft 129 of a potentiometer 130 carried by a yoke 131 on head 5. At its free end the scanning arm 128 is designed as a sensor 128*a* which, by the action of a torsion spring 132, applies against the edge of the workpiece W. The point of contact of the sensor 128*a* is arranged before the stitch hole 50*b* and laterally thereof. A pin 133 provided in yoke 131 serves for abutment of the scanning arm 128 when there is no workpiece W. The potentiometer 130 (FIG. 6) is connected to the control unit 105 via an amplifier 134.

During the operating process, the sliding wheel 47 and roll foot 80 transport the workpiece W automatically for execution of an edge-partial seam. With needle 13 withdrawn, the sliding wheel 47 and roll foot 80 execute the set amount of feed. The sensor 128*a* is then pressed by the torsion spring 132 against the edge of the workpiece S. In accordance with the respective form of the edge before the stitch formation point, the scanning arm 128 is subjected to a pivoting movement which rotates shaft 129 of potentiometer 130 from its zero position. The deviation picked up by potentiometer 130 are supplied via amplifier 134, as positive or negative values, to the control unit 105 which, in the phase of needle 13 inserted in the workpiece W, controls a number of stepping pulses corresponding to this deviation to the two step motors 42 and 96. Depending on positive or negative deviations, the step motors 42 and 96 are driven in forward or backward direction. With the advance of the workpiece W taking place laterally of the point of insertion of needle 13, the needle 13 serves as pivot, so that the workpiece W is rotated in such a way that the seam is always made at equal distance from the edge. The sewing process thus consists of a sequence of alternating feed and rotating processes.

Instead of a mechanical edge sensor, of course, photoelectric or other sensors may be used, without changing the essence of the invention.

While a specific embodiment of the invention has been shown and described in detail to illustrate the application of the principles of the invention, it will be understood that the invention may be embodied otherwise without departing from such principles.

What is claimed is:

1. A sewing machine comprising a housing, a main shaft rotatably mounted in said housing, stitch formation means operatively connected to said main shaft for forming stitches at a stitch formation point, a support mounted to said housing, a feed wheel mounted for rotation to said support and disposed adjacent to said stitch formation point for engaging and feeding a workpiece by selected amounts, a memory for storing digital data corresponding to feed amounts for said wheel, a pulse generator operatively connected to said main shaft for generating pulses, counting means connected to said pulse generator for counting pulses, said counting means being connected to said memory for receiving selected digital data therefrom corresponding to a desired feed amount, a power stage connected to said counting means for receiving said counted pulses and producing stepping pulses, and a step motor connected to said feed wheel for rotating said feed wheel and connected to said power stage for receiving stepping pulses to determine the feed amount for said feed wheel.

2. A sewing machine according to claim 1 including a transmission shaft mounted for rotation to said support, a ring gear connected to said feed wheel and a pinion connected to said transmission shaft and engaged with said ring gear, said step motor to said support and having an output shaft rigidly coupled to said transmission shaft.

3. A sewing machine according to claim 2 wherein said ring gear and pinion form a spiroid miter gearing, said pinion being engaged eccentrically with said ring gear.

4. A sewing machine according to claim 2 including an eccentric bolt mounted for rotation to said housing, said support being mounted on said eccentric bolt for movement with rotation of said eccentric bolt, and clamping means connected between said housing and said support for holding said support in a fixed position, said clamping means being spaced away from said eccentric bolt.

5. A sewing machine according to claim 2 wherein support comprises a tubular piece mounted to said housing for movement with respect to said housing and a tube received in said tubular piece and receiving said transmission shaft, said step motor being secured to said tube.

6. A sewing machine according to claim 1 wherein said stitch formation means includes a needle which reciprocates into and out of a workpiece for forming stitches therein, said sewing machine including turnoff means for stopping said stitch formation means with the needle withdrawn from a workpiece, reversing means having individually selectable first and second inputs and an output, said output connected to said counting means for applying pulses thereto, an oscillator connected to said first input of said reversing means, said pulse generator being connected to said second input of said pulse generator, and control means connected to said reversing means for selecting said second input to pass pulses of said pulse generator to said counter when said sewing machine is operating and for switching said reversing means to select said first input for connecting said oscillator to said counter when said sewing machine is at a standstill for applying pulses to said power stage to form stepping pulses for said step motor for reversing a feeding of a workpiece.

7. A sewing machine according to claim 6 including a switch connected to said control means for opening and closing said switch, said switch connected between said oscillator and said power stage for applying pulses directly to said power stage with said switch closed.

8. A sewing machine according to claim 1 including control means connected to said pulse generator, to said counting means and to said memory for applying the selected digital data to said counting means, said stitch formation means including a reciprocal needle reciprocating into and out of a workpiece at said stitch formation point, said control means including means for applying pulses to said power stage, both when said needle is withdrawn from workpiece for feeding the workpiece and when said needle is inserted into workpiece for causing rotation of the workpiece around said needle.

9. A sewing machine according to claim 8 including edge sensing means connected to said control means for sensing an edge of a workpiece at said stitch formation point, said control means operating to cause said counting means to apply pulses to said power stage when said needle is inserted into a workpiece, depending on a signal from said edge sensing means.

10. A sewing machine according to claim 5 including a mounting shaft mounted for rotation and for axial movement in a vertical direction to said housing, said tubular piece being fixed to a lower end of said mounting shaft, said feed wheel comprising a roll foot for engagement on top of a workpiece at said stitch formation point, a first coupling piece mounted for rotation on said mounting shaft and including a lug engaged with said housing for holding said first coupling piece from rotating, said first coupling piece having a lower recess with a ratchet groove and a bounding wall, a second coupling piece fixed to said mounting shaft and having a pin extending radially therefrom, said pin being engageable in said recess, said pin being disposed in said ratchet groove with said roll foot in an operating position over said stitch formation point, and said pin being engaged against said wall with said mounting shaft rotated to move said roll foot away from said stitch formation point.

* * * * *